United States Patent [19]

Wendt

[11] Patent Number: 4,463,535

[45] Date of Patent: Aug. 7, 1984

[54] GLASS STOP ASSEMBLY

[75] Inventor: Alan C. Wendt, Barrington, Ill.

[73] Assignee: United States Gypsum Company, Chicago, Ill.

[21] Appl. No.: 423,919

[22] Filed: Sep. 27, 1982

[51] Int. Cl.[3] ..... L04F 15/14

[52] U.S. Cl. ..... 52/397; 52/775; 52/781

[58] Field of Search ..... 52/773, 397, 775, 780, 52/781, 403

[56] References Cited

U.S. PATENT DOCUMENTS

| | | | |
|---|---|---|---|
| 3,147,518 | 9/1964 | Horgan | 52/397 |
| 3,334,463 | 8/1967 | Maessel | 52/775 |
| 3,403,491 | 10/1968 | Eichman | 52/775 |
| 3,527,010 | 9/1970 | Brzezinski | 52/397 |
| 4,207,717 | 6/1980 | Hubbard | 52/775 |

FOREIGN PATENT DOCUMENTS

| | | | |
|---|---|---|---|
| 593089 | 2/1960 | Canada | 52/397 |
| 1240663 | 7/1971 | United Kingdom | 52/397 |
| 1590272 | 5/1981 | United Kingdom | 52/403 |

*Primary Examiner*—Henry E. Raduazo

*Attorney, Agent, or Firm*—Samuel Kurlandsky; Robert H. Robinson; Robert M. Didrick

[57] ABSTRACT

A demountable glass stop assembly for use in non-bearing partition wall glazing systems, comprising in combination a pair of elongate members preferably formed by extrusion, each of the elongate members being substantially U-shaped in cross-section, a first elongate member having a laterally extending planar arm terminating in a hook at the end thereof, the second elongate member having a detent hook at the end of a leg thereof complementary with and adapted to engage the hook of the first elongate member, and having a protuberance extending from a portion thereof, and a glazing spline of an elastomeric material having a notch provided therein engaging the protuberance of the second elongate member, and having means for engaging a glass pane placed between the first and second elongate members, thereby providing a resilient biasing force urging the second elongate member away from the first elongate member and thereby maintaining the hook of the first elongate member engaged with the detent hook of the second elongate member.

8 Claims, 6 Drawing Figures

GLASS STOP ASSEMBLY

BACKGROUND OF THE INVENTION (1) Field of the Invention

This invention relates to a glazing system comprising a readily demountable glass stop assembly of two elongate members formed preferably by extrusion and a glazing spline, for installation in interior partition walls with borrowed lights or side lights.

(2) Description of the Prior Art

Many glazing systems for glass panes in interior partition wall constructions exist in the prior art. Generally, such systems comprise a glazing channel to enclose and surround the edges of a glass pane proximate the ceiling or top of the opening into which the glass pane is glazed, or to a wall or other structure perpendicular to the glass pane, mullion posts to enclose and receive the edges of glass panes immediately proximate one to the other in either coplanar or perpendicular array, and a glass stop assembly to receive and engage the edge of the glass pane proximate the sill, rail cap or top of the partition of less than ceiling height. Since weatherproofness in such a partition wall glazing assembly is not required, typically a glazing spline of elastomeric material of irregular cross-sectional conformation is used to effect a firm seal between the glass pane and the glass stop itself; the irregular cross-sectional conformation of the glazing spline is made necessary by the large variation in given nominal thickness of tempered glass which is typically used in such indoor partition wall glazing assemblies.

Also typically, the glass stop assemblies of the prior art are composed of at least two lineal moldings or extrusions a portion of one of which extends beneath the lower edge of the glass pane and into mechanical securement or attachment with a portion of the other molding or extrusion by means of detents, click stops, ratchet catches, or a ratchet and pawl type grooving in the mating surfaces of the components. The prior art also contains glass stop assemblies for partition wall glazing systems in which each component of the assembly is individually and independently fastened to the sill or the top of the partition less than ceiling height; such physically non-interacting components do not constitute relevant prior art to this instant invention.

The physically or mechanically interacting glass stop assemblies of the prior art are generally expensive in regard to their materials of fabrication, fall short in esthetic considerations and eye appeal and, more importantly, are not readily and easily demountable once installation has been made; that is, installation of such glass stop assemblies, once made, is for all practical purposes permanent.

SUMMARY OF THE INVENTION

It is accordingly, an object of the present invention to provide a glass stop assembly for use in partition wall constructions which is economical in its material of construction.

It is a further object of the invention to provide a glass stop assembly which is esthetically acceptable and which is readily and easily demountable from its initial installation and which is further remountable in the same or a different location.

It is a further concomitant object of the invention to provide a glazing spline of elastomeric material and of irregular cross-sectional conformation to effect a firm seal between the glass pane and the glass stop assembly notwith standing the large variation in given nominal thickness of tempered glass typically used in indoor partition wall glazing assemblies.

The objects of this invention are attained with the disclosure herein of a novel glass stop assembly for use in nonbearing partition wall glazing systems such as full or cornice height partitions with borrowed lights or side lights, or partially glazed bank rails. The glass stop assembly comprises, in addition to a glazing spline of an elongate extrusion of elastomeric material integral with a nonstretchable cord which restricts stretching of said spline, two elongate members in the form of lineal moldings or extrusions a portion of one of which extends beneath the lower edge of the glass pane into easily and readily demountable mechanical attachment with a portion of the other elongate member which does not so extend beneath the lower edge of the glass pane. The first elongate member comprises in cross-section a generally U-shaped portion from the terminus of which a planar arm extends generally perpendicular thereto, terminating in a hook portion comprising an arm generally perpendicular to the planar arm and generally parallel to the flange of the U-shaped portion form which the planar portion extends, the hook terminating in a member parallel to the planar arm and perpendicular to the flange of the U-shaped portion from which the planar arm extends, the end of the flange of the U-shaped portion opposite that end from which projects the planar arm having a protuberance extending therefrom parallel to the planar arm.

The second elongate member of the glass stop assembly of this invention is also U-shaped in cross-section and having flanges of unequal lengths the shorter flange thereof having a return edge or detent extending inwardly of the U-shaped at the terminus thereof. The glazing spline of the glass stop assembly of this invention is designed to be force fit between the glass pane proximate the lower edge thereof and a protuberance of the second elongate member which extends outward of the generally U-shaped member.

DESCRIPTION OF THE PREFERRED EMBODIMENT

Figure 1:
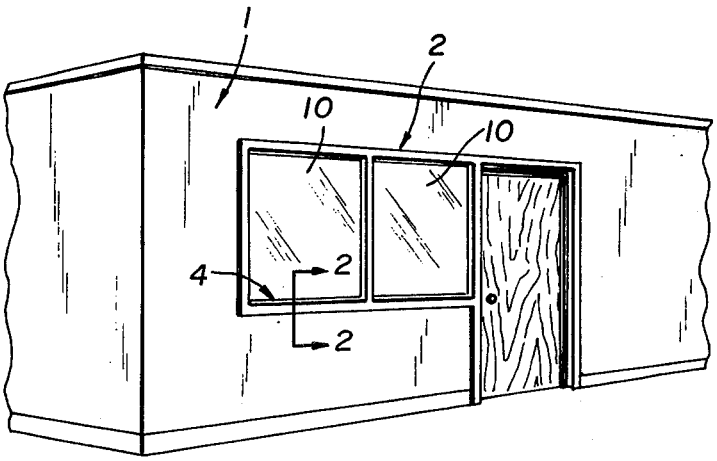
FIG. 1 is a perspective view of a partition wall having installed therein a borrowed light which is glazed at the lower edge thereof with the glass stop assembly of this invention.

Referring to FIG. 1, a perspective view is shown of a partition wall 1 having installed therein a borrowed light 2 having a glass pane which is glazed along its lower edge with the glass stop assembly 4 of this invention. It should be understood that the glass stop assembly 4 of FIG. 1 may be used in a side light, borrowed light or atop the sill, rail cap in a ceiling height partition, cornice height partition, or of any partition less than ceiling height to receive and engage the edge of a glass pane proximate that sill, rail cap or top of the partition.

Figure 2:
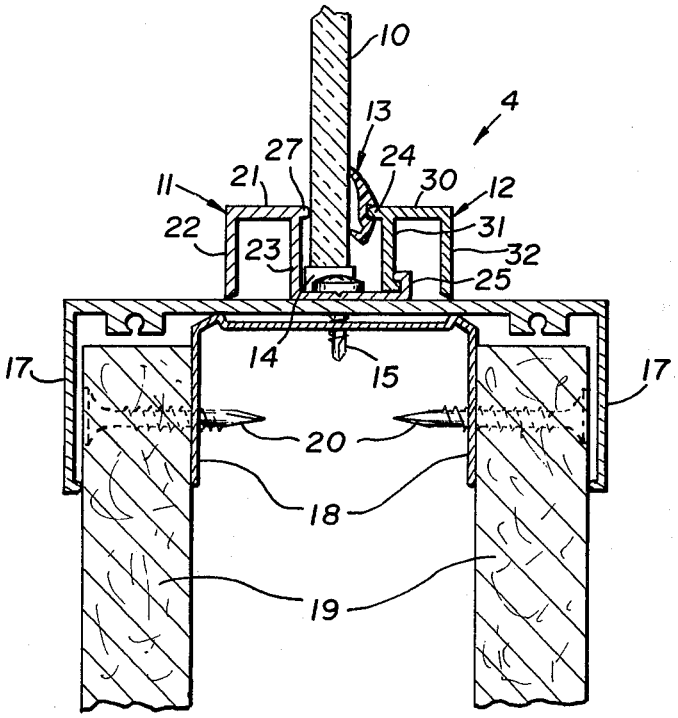
FIG. 2 is a cross-sectional view of the glass stop assembly of FIG. 1 taken along section line 2—2 of FIG. 1.

Referring to FIG. 2, a cross-section of the preferred embodiment of the glass stop assembly 4 of the invention is shown. The structure includes a glass pane 10 glazed at its lower edge with the glass stop assembly 4 of this invention. The glass stop assembly comprises a first elongate member 11, a second elongate member 12 and glazing spline 13. The elongate members 11 and 12 are advantageously formed by extrusion. The first elongate member 11 is attached to the top of a partition 17, which is a sill, rail cap or plain rail, and to a metal runner or header 18 by conventional screw attachment means 15. The entire assembly of plain rail 17, metal runner or header 18, the glass stop assembly 4 comprising elongate members 11 and 12, and glazing spline 13 rest on a partition wall of less than ceiling height comprising conventional wall panels 19. A block 14 is placed below the edge of the glass pane 10 in order to accomplish elevating and leveling of glass pane. Screws 20 are used to affix the wall panels 19 to the metal runner 18. Although not shown in the drawings, it is of course contemplated that the glass stop assembly 4, of FIG. 2 may be used in conjunction with a glazing channel to enclose and surround the edges of the glass pane proximate the ceiling or top of the opening into which that pane is glazed. Additionally, mullion posts may be used to enclose and receive the edges of glass panes immediately proximate one to the other in either coplanar or mutually perpendicular array.

Figure 3:
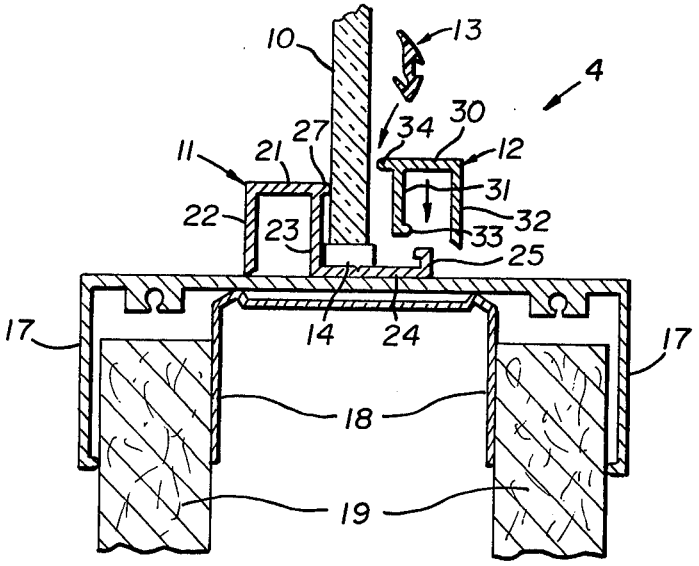
FIG. 3 is a cross-sectional view of the glass stop assembly of FIG. 2 illustrating the method of assembly thereof.

Referring to FIG. 3, a partially exploded cross-sectional view of the glass stop assembly of FIG. 2 is shown in which like elements are numbered identically to those of FIG. 2.

Figure 4:
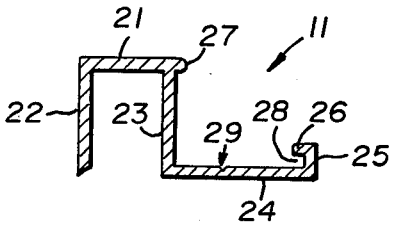
FIG. 4 is a cross-sectional view of the first elongate member of the glass stop assembly of this invention.

Referring to FIG. 4, the first elongate member 11 having a U-shaped cross-section is shown in detail and comprises a base 21, a flange 22 perpendicular thereto, and a flange 23 also perpendicular to the base 21. An optional protuberance 27 extends beyond the flange 23 as an extension of base 21 for contact with the glass. A planar arm 24 is connected to an edge of the flange 23 and arranged perpendicular thereto and distal with respect to the elongate member 11. As shown in FIG. 3, the arm 24 passes under the window pane 10. At the edge of the arm 24 is a hook 25 having an inwardly turned flange 26 at an edge thereof defining a notch 28 together with the hook 25 and arm 24. A groove 29 may be provided along the arm 24 to facilitate the placing of self-tapping screws therein by indicating where the center is and also acting as a guide for starting the screws.

Figure 5:
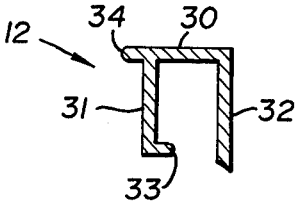
FIG. 5 is a cross-sectional view of the second elongate member of the glass stop assembly of this invention.

Referring to FIG. 5 the second elongate member 12 having a U-shaped cross-section is shown in detail comprising a base 30, flanges 31 and 32 perpendicular thereto, and a protuberance 33 perpendicular to and attached to the flange 31. A glazing spline-engaging protuberance 34 extends beyond the flange 31 as an extension of the base 30.

Figure 6:
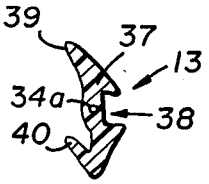
FIG. 6 is a cross-sectional view of the glazing spline shown in FIGS. 2 and 3.

Referring to FIG. 6, the elastomeric glazing spline 13 is shown, comprising a body 37, a notch 38 provided in the body for receiving the glazing spline-engaging protuberance 34, and an optional non-stretchable cord 34*a* to restrict stretching of the spline. Glass pane-engaging edges 39 and 40 are also provided on the body 37.

In the assembly of a borrowed light such as that shown in FIG. 1, the sill, rail cap, plane rail or top of a portion of the partition less than ceiling height, are first furnished with metal runner or header 18 suitably attached to wall panels 19 as shown in FIG. 2. This is followed by installation of the sill, rail cap or plain rail 17 to finish the top of the partition less than ceiling height. After the first elongate member 11 has been affixed to the bottom edge of the borrowed light opening, a glazing channel has been affixed to the ceiling or top of the borrowed light opening, and after a glazing channel or mullion post has been affixed to a vertical edge of the borrowed light opening, a glass pane is then placed within the window opening in such a manner that the upper edge thereof is enclosed and surrounded by the glazing channel proximate the ceiling or top of the opening and the first vertical edge thereof is enclosed and received within the first vertical glazing channel or mullion post. Subsequently, a second vertical glazing channel or mullion post is brought into position to enclose and surround the second vertical edge of the glass pane; this second vertical glazing channel or mullion post is then fastened into place. Finally, the elongate member 12 is mounted with the protuberance 33 engaged in the notch 28 of the first elongate member 11. A glazing spline 13 is finally inserted between the protuberance 34 and the glass pane 10, maintaining the entire assembly in fixed position.

The structure of the present invention has several advantages over prior art structures. First, it is easy and relatively inexpensive to fabricate. Second, it provides a strong supporting structure for mounting a glass pane. Third, the structure of the present invention is readily demountable once the installation has been made.

It is to be understood that the invention is not to be limited to the exact details of operation or materials described and shown as obvious modifications and equivalents will be apparent to one skilled in the art.

Invention is claimed as follows:

1. A demountable glass stop assembly defining a recess for mounting and retaining the edge of a glass pane on a supporting base, comprising in combination, a. a first elongate member generally U-shaped in cross-section and comprising a base and a pair of flanges extending therefrom, one flange proximal and one flange distal with respect to said recess, a planar arm extending from the edge of said proximal flange adapted to rest on said supporting base in a direction perpendicular to said flange and directed away from said first elongate member, said planar arm terminating in a hook directed back toward said first elongate member, b. a second elongate member generally U-shaped in cross-section comprising a base and a pair of flanges extending therefrom, one flange proximal and one flange distal with respect to said recess, the proximal flange of said second elongate member being provided with a detent directed toward the distal flange of said second elongate member, said detent being adapted to be engaged by the hook of the planar arm of said first elongate member, the base of said second elongate member extending beyond said proximal flange to form a protuberance, the ends of the distal flanges of said first and said second elongate members being substantially co-planar with the lower surface of said planar arm, and c. an elongate glazing spline formed of an elastomeric material having a notch provided therein for engaging the protuberance of said second elongate member and having means for engaging the surface of a glass pane positioned in the recess between said first and said second elongate members, said glazing spline providing a biasing force urging said second elongate member in a direction away from said first elongate member and thereby maintaining said hook and said detent in locking engagement.

2. The demountable glass stop assembly of claim 1 in which the planar arm of said first elongate member is provided along its length with a continuous groove.

3. The demountable glass stop assembly of claim 1 wherein the first and second elongated members therein comprise aluminum.

4. The demountable glass stop assembly of claim 1 in combination with a glass panel, a glazing channel for the receiving engagement of the upper edge of said glass panel, and mullions for the receiving engagement of the lateral edges of said glass panel.

5. The demountable glass stop assembly of claim 1, in which the elastomeric glazing spline is integral with a non-stretchable cord to restrict stretching of said spline.

6. The demountable glass stop assembly of claim 1, wherein the base of said first elongate member has a protuberance extending therefrom for engaging the surface of a glass panel.

7. The demountable glass stop assembly of claim 1, wherein the hook of the planar arm of said first elongate member is formed of a panel portion perpendicular to said planar arm and a second portion perpendicular to said perpendicular portion.

8. A demountable glass stop assembly according to claim 1, wherein the detent of said second elongate member comprises a panel portion perpendicular to the flange of which it is a part and directed toward the second flange of said second elongate member.

* * * * *